United States Patent [19]

Smilgys

[11] 4,425,498

[45] Jan. 10, 1984

[54] METHOD AND SYSTEM FOR EXPANDING THE READOUT OF A FUEL PUMP REGISTER

[75] Inventor: Bruno S. Smilgys, Hartford, Conn.

[73] Assignee: Veeder Industries Inc., Hartford, Conn.

[21] Appl. No.: 412,921

[22] Filed: Aug. 30, 1982

[51] Int. Cl.[3] ..... B67D 5/22

[52] U.S. Cl. ..... 235/1 A; 235/1 C; 235/94 R; 235/142

[58] Field of Search ..... 235/1 A, 1 C, 1 R, 94 R, 235/94 A, 139 R, 137, 140, 142, 143, 144 D

[56] References Cited

U.S. PATENT DOCUMENTS

| | | | |
|---|---|---|---|
| 2,814,444 | 11/1957 | Bliss | 235/94 R |
| 2,928,288 | 5/1960 | Bliss et al. | 235/139 R X |
| 3,216,659 | 11/1965 | Ambler et al. | 235/144 D |
| 3,223,316 | 12/1965 | Coulter et al. | 235/1 R |
| 3,618,852 | 11/1971 | Avon et al. | 235/94 R |
| 3,962,568 | 6/1976 | Lathrop | 235/1 A X |
| 4,142,672 | 3/1979 | Smilgys | 235/144 D |

*Primary Examiner*—Benjamin R. Fuller

*Attorney, Agent, or Firm*—Prutzman, Kalb, Chilton & Alix

[57] ABSTRACT

An expanded readout system and a method for expanding the readout of a resettable fuel pump register employs a shutter pinion, a shutter having a pawl assembly, and a stop means for each of the counters to be expanded. The pawl assembly may comprise one of two pawl structures depending on the counter. The expanded readout operates in conjunction with the mechanical system of the register to record the expanded readout and to reset the readout by rotation of the shutter.

47 Claims, 3 Drawing Figures

METHOD AND SYSTEM FOR EXPANDING THE READOUT OF A FUEL PUMP REGISTER

This invention relates generally to resettable registers of the type employed in fuel dispensing apparatus for registering the volume and monetary amount of fuel delivery. More particularly this invention relates to a method and a system for expanding the volumetric and/or monetary readout of fuel pump register.

The present invention has particular utility in the factory modification and/or the field or factory conversion of existing fuel/register assemblies of the type having a register generally as shown and described in U.S. Pat. No. 2,814,444 of Harvey N. Bliss dated Nov. 26, 1957 and entitled "Register". The conventional mechanical fuel pump register of the type shown and described in U.S. Pat. No. 2,814,444 has upper and lower resettable cost and volume counters on each of two opposite sides of the register for registering the cost and volume amounts of the fuel delivered. Such conventional fuel pump registers employ a plurality of wheels of ascending order to register the volume and monetary amount of the fuel delivered. Typically, four decade wheels are employed in connection with both the monetary and volume amounts so that for example, the maximum monetary readout is $99.99, and if the volume is measured in hundredths, the maximum volume readout is 99.99 gallons.

Because of the escalating cost of fuel and because of the increased frequency of purchases of larger fuel volumes, there are a number of instances in which a fuel pump register having an increased readout capacity is advantageous. The present invention is directed to modifying existing registers to add an additional readout indicator such as a lead digit "1" or some other indicia indicating that the readout of the register is in the state of over capacity. Thus, for example, application of the present invention to existing fuel pump registers having a four decade volumetric and monetary readout could provide for increased volume readout maximum of 199.99 gallons, and in the case of a monetary readout could provide for an increased monetary readout maximum of 199.99 dollars.

There are a number of design constraints that are inherent in the conversion or modification of existing fuel pump registers. Of critical concern are the spatial and dimensional constraints which must be accommodated not only by virtue of the addition of an expanded readout means for each counter, but also in terms of providing the requisite mechanical means to coordinate the mechanical operation of the expanded readout system with the existing operating system of the register. In conventional fuel pump registers each counter is integrated into the register in an efficient manner so that the precise mechanical operation of each counter may not be identical relative to the other contents of the register (for example, direction of rotation of counter wheels, corresponding reset gears, corresponding counting gears, and corresponding transfer pinions) thus dictating distinct design considerations for the readout expansion of each counter. Optimal advantages for an expanded readout are also a function of the ease and efficiency with which the conversion or modification of existing registers can be accomplished to provide the expanded readout.

BRIEF SUMMARY OF THE INVENTION

The invention in one form employs a shutter which is rotatably mounted to the counter shaft adjacent the reset gear of the highest order counter wheel. The shutter has an indicia surface which in a preferred form may comprise merely a blank portion contiguous to a portion bearing the numeral "1". A shutter pinion is mounted on the transfer pinion shaft. A pawl which is engageable with the shutter pinion is pivotally mounted on the shutter so that the actuation of the shutter pinion by the highest order counter wheel in turn acts through the pawl to force a rotation of the shutter to provide an expanded readout by registering a lead numeral "1". Means are also provided to reset the shutter to the blank position.

The shutters and the particular pawls may assume a number of forms depending upon the particular register and the specific orientation of the shutter to be installed relative to the mechanical drive and reset mechanisms already in place within the register. In one form, the pawl has a substantially bow-like shape. The pawl is pivotally mounted at one end to the shutter and has at the other end a tapered tip adjacent a serrated surface terminating in a tooth adapted to engage the adjacent reset gear. In a second form, the pawl has a substantially V-shaped structure and is pivotal about its vertex, having at one end a shoulder adapted to engage with the shutter pinion, and at the other end a serrated surface and a tooth adapted to engage the adjacent reset gear. In both forms when the register is in the resetting mode, the pawl engages the adjacent reset gear and the shutter is rotated to the blank or zero position. A stop means is also provided to help disengage the pawl from the reset gear after the shutter is reset to its blank or zero position.

The method of incorporating the expanded readout system within the fuel pump register in addition to employing the providing of a shutter pinion, a shutter having a pawl means, and a stop means, may involve the steps of mounting the shutter pinion on the transfer pinion shaft, mounting the shutter at the highest order end of the counter shaft, mounting the stop means to the adjacent side frame, and the steps of aligning the stop means on the shutter and the shutter pinion with the pawl means. The steps may be repeated for each of the counters of the register together with the selection of the shutter/pawl assembly required for each of the specific counters to which the readout is expanded. In addition, it is preferable that the dial face be replaced by a dial face having an additional window to provide a mask for expanded readout.

It is an object of the present invention to provide a method and a system for expanding the readout of a fuel pump register by modifying existing registers to enlarge the available monetary and volumetric readouts and thereby provide for the registering of a substantially larger fuel delivery.

It is another object of the present invention to provide a method and a system for expanding the readout of a fuel pump register which requires a minimal number of components and can be accomplished in a relatively easy manner.

It is another object of the present invention to provide a method and a system for expanding the readout of a fuel pump register which can be efficiently obtained by conversion of existing registers and counters.

It is a further object of the present invention to provide a method and a system for expanding the readout of a fuel pump register which is reliable and can be implemented with the existing mechanical system of the register.

It is a yet further object of the present invention to provide a method and a system for expanding the readout of a fuel pump register which may be obtained for expanding the readout of all of the counters of the fuel pump register.

Other objects and advantages of the invention will be become apparent from the accompanying drawings and detailed description.

DETAILED DESCRIPTION OF THE DRAWINGS

Figure 1:
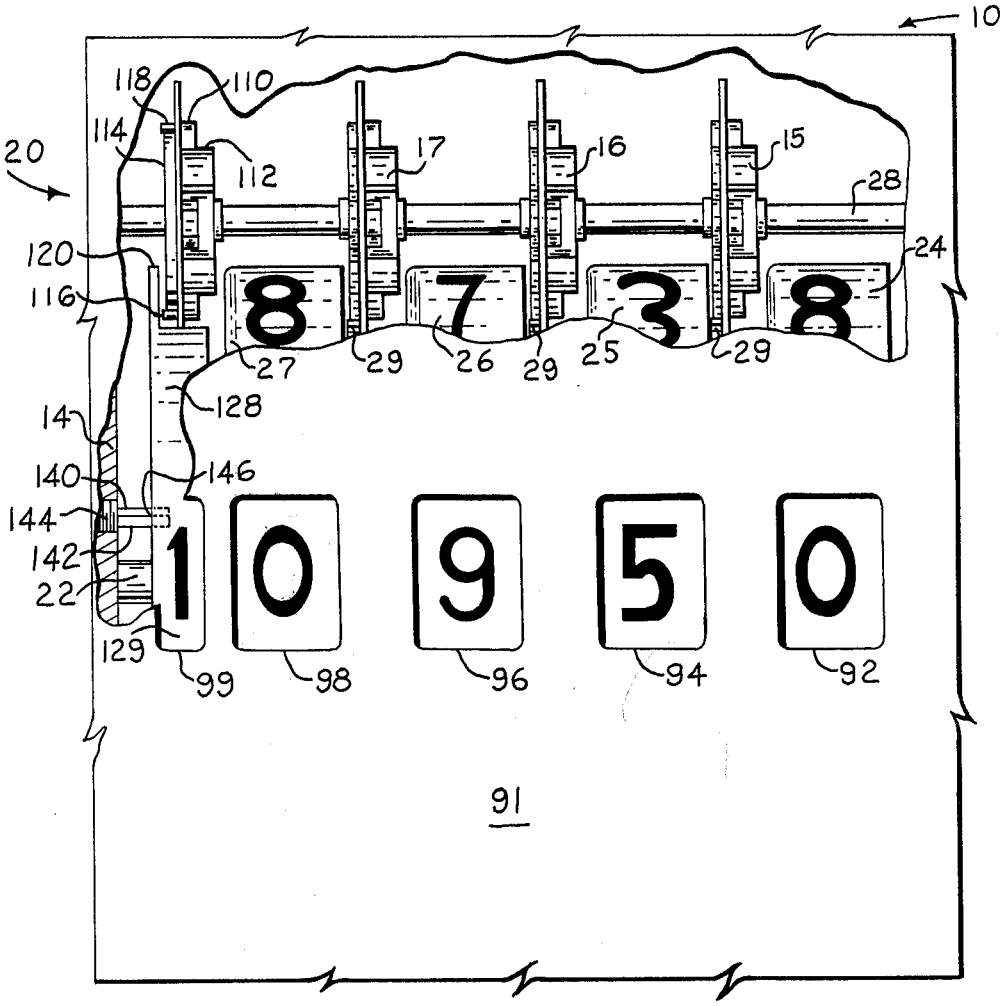
FIG. 1 is a partial front view of the front upper portion of a register employing the invention, partly broken away and partly in section.

Referring now to the drawings in detail, wherein like reference numerals indicate like parts, there is shown a portion of a fuel pump register 10 of the type shown in U.S. Pat. No. 2,814,444 of H. N. Bliss dated Nov. 26, 1957 and entitled "Register". Register 10 may be substantially identical to the Register shown in U.S. Pat. No. 2,814,444 excepting as hereinafter described.

Figure 2:
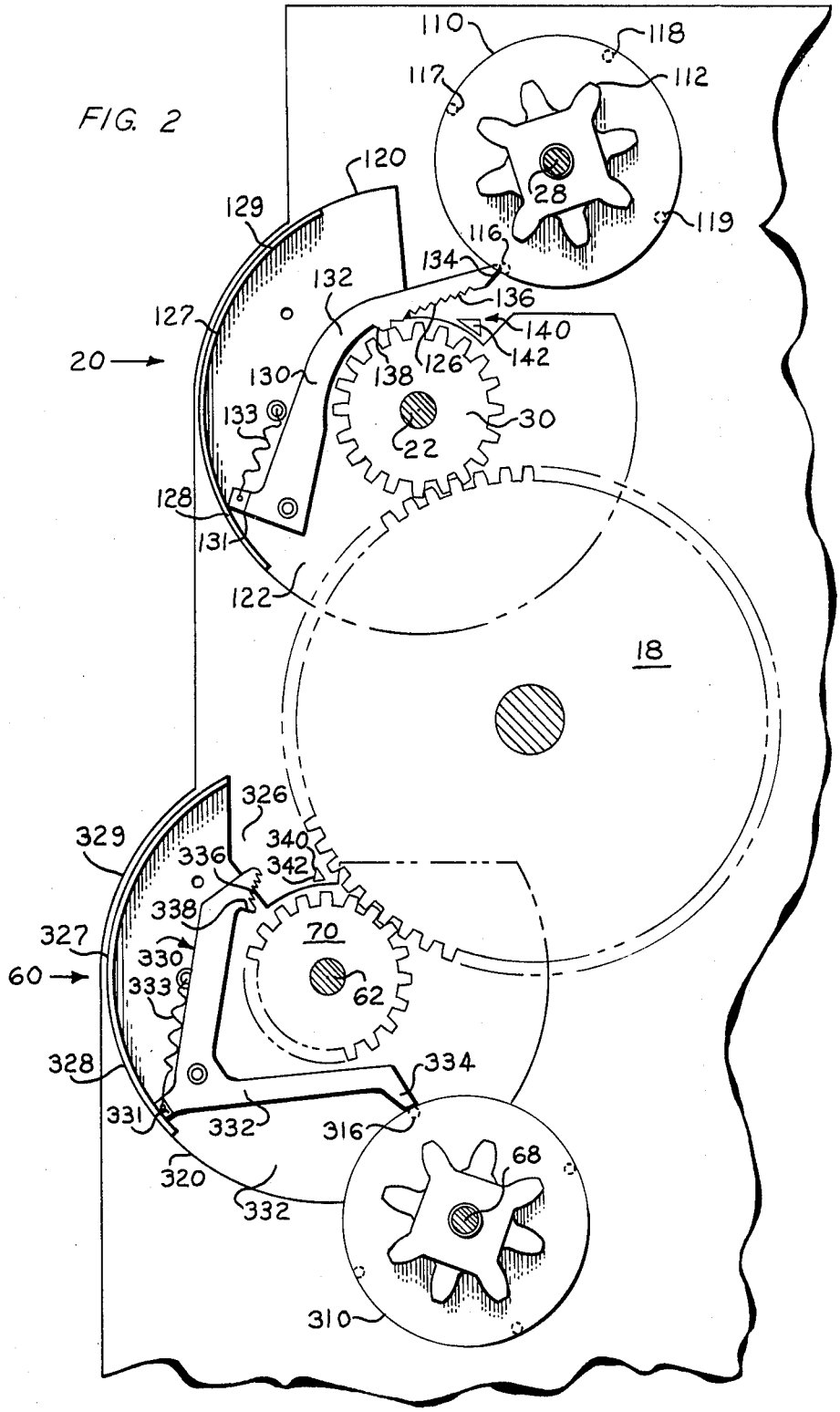
FIG. 2 is a partial interior side view of an enlarged portion of the left hand portion of the register of FIG. 1 looking toward the left side thereof illustrating the invention, partly in section and partly in diagrammatic form.
Figure 3:
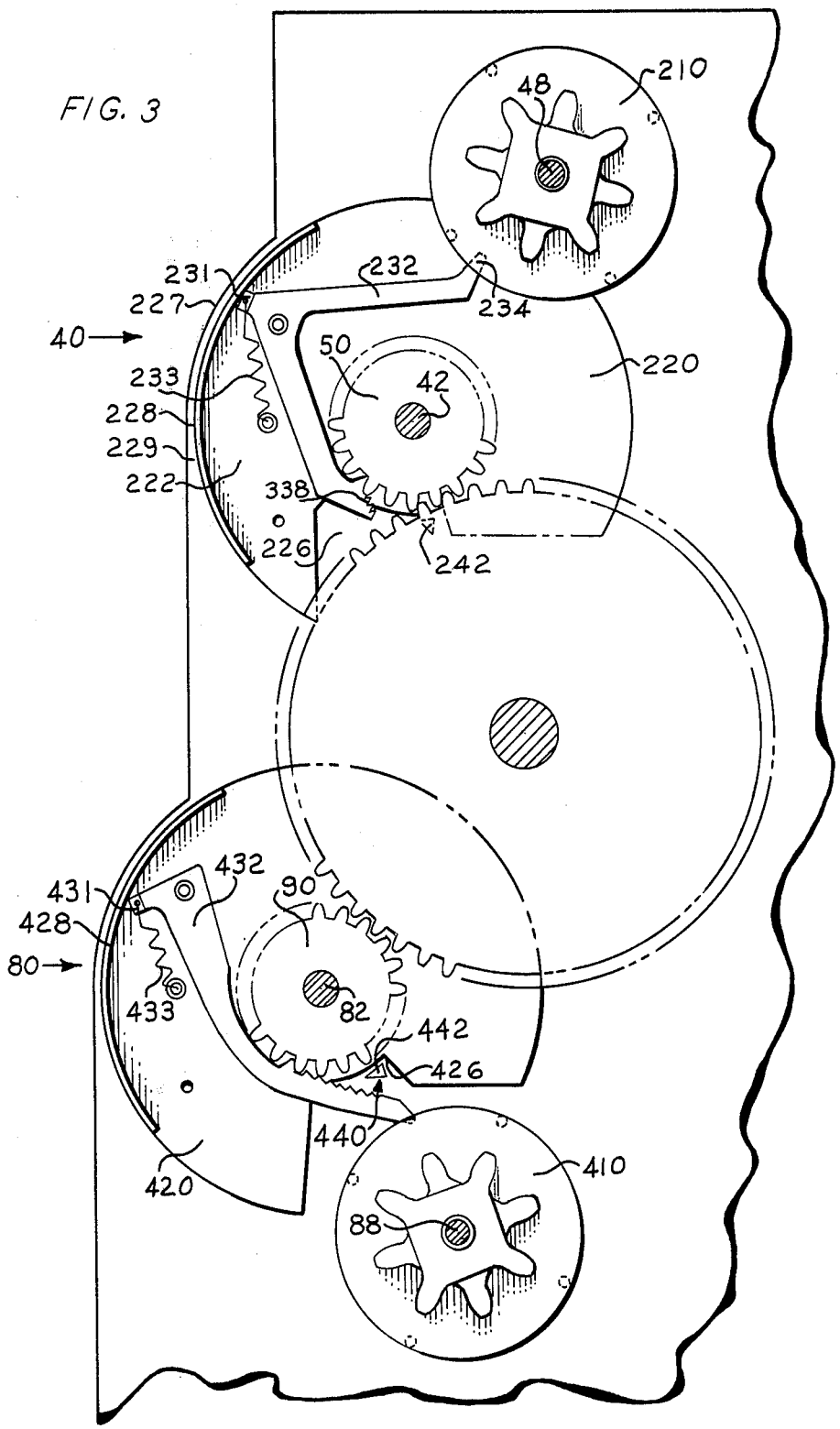
FIG. 3 is a partial interior side view of an enlarged portion of the rear side portion of the register of FIG. 1 generally opposite to that illustrated in FIG. 1, and looking to the right side thereof, further illustrating the invention, partly in section and partly in diagrammatic form.

With reference to FIGS. 1, 2 and 3, it will be appreciated that the fuel register 10 (only portions of which are illustrated) comprises upper oppositely facing front and rear cost counters 20 and 40 and oppositely facing front and rear volume counters 60 and 80 in the lower portion of the register (only portions of which counters are illustrated). FIG. 2 shows the invention in relation to a portion of the upper front cost counter 20 and the lower front volume counter 60 and FIG. 3 illustrates the invention in conjunction with a portion of the upper rear cost counter 40 and the lower rear volume counter 80. The views of FIGS. 2 and 3 are interior of the register essentially looking toward opposite sides of the pump register of FIG. 1.

Although the present invention is adaptable for use in conjunction with a wide variety of registers and counters, the preferred environment of the invention is for use in conjunction with a register of the type generally described in U.S. Pat. No. 2,814,444 which comprises a frame with a pair of upstanding side plates 14, only one of which is illustrated in FIG. 1, and two pairs of vertically spaced counters 20, 40, 60 and 80 having axially shiftable wheel support shafts 22, 42, 62 and 82, respectively, mounted on the side plates.

The invention can best be appreciated by first referring to a single counter which for purposes of illustration is the front cost counter 20 which is partially illustrated in FIGS. 1 and 2. A plurality of counter wheels (usually four) are rotatably mounted on each of the shafts. The counter wheels have outer rims bearing indicia denoting a numeric sequence zero through nine. Counter 20 thus comprises as shown in FIG. 1, the other counters being substantially similar, four coaxial decade counter wheels 24,25,26 and 27 of increasing order from right to left which are adapted to be driven via a counter drive gear assembly (not shown) for registering the accumulated cost amount of fuel delivered up to a maximum of $99.99. The cost counter wheels may be identical to those shown in U.S. Pat. No. 4,142,672 of B. S. Smilgys dated Mar. 6, 1979 and entitled "Counter Wheel Assembly With Improved Reset Control Mechanism". The invention is also applicable to registers having counter wheels employing one or more counter wheels which are not decade wheels, but may have, for example, forty or a hundred sequential intervals on the lowest order counter wheel.

Each of the coaxial wheels is connected by intermediate mutilated eight-tooth transfer pinions 15, 16 and 17 which are rotatably mounted on a transfer pinion shaft 28 extending parallel to the wheel shaft 22. With reference to FIGS. 2 and 3, the corresponding transfer pinion shafts for counters 40,60 and 80 are designated 48, 68 and 88, respectively.

Each of the counter wheels has a hub and a drive gear rotatably mounted on one end of the hub (at the right end of the hub) as illustrated in FIG. 1 or at the right end of the hub as viewing the counter wheel for readout of the count. Portions of the drive gear for wheels 25–27 are shown in FIG. 1 and designated by numeral 29.

A reset gear is rotatably mounted on the hub at the opposite end of the hub and a combination locking ring and two-tooth gear segment (neither of which is shown) is integrally formed with the hub. Reset gears are only illustrated for the highest order counter wheels and are designated by numerals 30,50,70 and 90 corresponding to the highest order counter wheels of counters 20,40,60 and 80, respectively.

The transfer pinions are engageable with the drive gears and combination locking ring and two-tooth segment of adjacent higher and lower counter wheels for generating transfers from each lower to each adjacent higher order counter wheel as described in detail in U.S. Pat. No. 2,928,288. The drive gear of the lowest order counter wheel (not shown) is connected to be driven by a counting gear assembly to rotate the counter to register the volume of the fuel delivered and/or the cost of the fuel delivered in accordance with the unit volume price of fuel which is conventionally established by a settable variator (not shown) associated with the register.

The four cost wheels of cost counter 20 as shown in FIGS. 1 and 2 have a generally conventional construction and are adapted to be mechanically reset to zero between fuel deliveries in a conventional manner by axially shifting the support shafts and by rotating the reset gears via an intermittent gearing system (not shown) as described in U.S. Pat. No. 2,814,444. The four parallel volume and cost counters 20,40,60 and 80 are mechanically reset together in a conventional manner either manually as generally disclosed in U.S. Pat. No. 2,814,444 or by an electric motor driven reset mechanism of a type, for example as shown in U.S. Pat. No. 3,216,659 of A. C. Ambler et al dated Nov. 9, 1965 and entitled "Resetting Control Mechanism For Counting Device".

In a conventional manner, the counter shaft may be further provided with spaced annuli which normally receive inwardly projecting ends of pawls (not shown) to provide for engagement of the wheel drive gears and disengagement of the reset gears by axially displacing the counter shaft. The pawls are pivoted to engage the reset gears and disengage the drive gears thereby conditioning the counter wheels to be reset to zero. During the resetting of the counter between fuel deliveries, the reset gears are suitably driven to rotate the counter wheels to a zero position. When each of the counter wheels reaches its zero position, the inner end of a pawl may be received within an axial slot in the counter shaft to disengage the reset gear and also simultaneously lock the counter wheel against further rotation, such as shown in U.S. Pat. No. 3,223,216.

The register may also be provided with a front and rear dial face having a mask to define a plurality of windows in alignment with the counter readout to facilitate the efficient visual readout of the counter. A portion of a dial face 91 having windows 92,94,96 and 98 is illustrated in FIG. 1.

The foregoing description is exemplary of a type of resettable register to which the present invention relates. Such description though not to be deemed limiting is set forth for purposes of illustrating the present invention.

As will become apparent, the expanded readout system for a given counter of the register may assume a specific structural form and operational embodiment dependent upon the specific counter. For purposes of clarity, the components associated with counters 20, 40, 60 and 80 are designated by corresponding three digit numerals beginning with the numerals 1,2,3 and 4, respectively. Analogous components of the expanded readout system are assigned numerals having identical last two digits.

With reference to the front cost counter 20 of FIGS. 1 and 2, the expanded readout is generally accomplished by means of provision of a shutter pinion 110, a shutter 120, a pawl means 130, and a stop means 140.

The shutter pinion 110 is rotatably mounted on the transfer pinion shaft 28 proximate the higher order end thereof and substantially equidistantly spaced from the highest order transfer pinion 17 as the next highest order transfer pinion 16. Shutter pinion 110 comprises, in preferred form, an input portion 112 having a mutilated eight-tooth transfer segment substantially identical to the input portion of a conventional transfer pinion for indexing the transfer pinion a predetermined angle of 90 degrees as the lower order counter wheel is indexed from "nine" to "zero" such as described in U.S. Pat. No. 2,928,288. The shutter pinion 110 is positioned so that a conventional two-tooth transfer gear segment of the highest order counter wheel is engageable with the eight-tooth input portion 112 so as to rotate the shutter pinion 90 degrees when the highest order counter wheel is indexed from "nine" to "zero". The output portion 114 of the shutter pinion comprises four equiangular spaced pins 116–119 arranged at the periphery of the shutter pinion and extending toward the higher order end of the counter.

The shutter 120 has a disc-like hub portion 122 having a slot 126 at the periphery thereof. An indicia rim 128 extends orthogonal to the hub portion 122 around a portion of the shutter periphery. In a preferred form, the face of the indicia rim 128 is a blank portion 127 contiguous to a second portion 129 bearing the numeral "1". In the shutter 120, the numeral "1" is adjacent the top of the indicia rim 128. The word "over-range" or a similar notation may be employed in place of the numeral "1". The shutter functions in a manner similar to the counter wheels in that rotation of the indicia rim 128 provides a counter readout by suitable alignment of either the blank portion with a readout window 99 (blank position) or the numeral "1" with the readout window (expanded position).

Pawl means 130 in general cooperates with shutter pinion 110, shutter 120, and reset gear 30 to rotate the shutter from a blank position to an expanded position upon actuation by the shutter pinion 110 and to return the shutter to the blank position upon interaction with the reset gear 30. Pawl means 130 comprises a substantially bow-shaped pawl 132 pivotally mounted at one end to shutter 120 in eccentric relation thereto. Pawl 132 is further adapted at the end opposite the pivot with tapered tip 134 which is adapted to bear against a pin of the shutter pinion 110 as illustrated in FIG. 2. Interiorly adjacent the tapered tip 134 are a plurality of teeth or a serrated surface 136 terminating with a large tooth 138 adapted to engage the teeth of reset gear 30. Pawl 130 further comprises proximate the pivot end of a spring bracket 131. A spring 133 connecting between spring bracket 131 and the shutter hub portion 122 urges pawl 132 to pivot in the clockwise direction as shown in FIG. 2 so that tooth 138 is urged into engagement with the reset gear 30.

With further reference to FIGS. 1 and 2, stop means 140 comprises a stop 142 which is attached to side frame 14 adjacent the shutter 120 which in turn is mounted at the higher order end of the counter shaft 22 adjacent the highest order reset gear 30. Shutter 120 and stop 142 are aligned so that the stop is received in the slot 126. Stop 142 is an elongated member having at one end a threaded portion 144 and at the opposite end 146 a substantially triangular cross-section.

The sides of the slot 126 may be dimensioned so that a stop 142 interacts with slot 126 to define the rotational limit of the shutter 120. It should be noted that the expanded readout provided by shutter 120 essentially comprises two values, a zero or blank value and a one or over-range value. The readouts are essentially displayed in a manner analogous to that of the conventional counter wheels so that a 36 degree rotation of the shutter is sufficient to provide the expanded readout.

It will be appreciated from the description below that the foregoing components when properly installed in conjunction with existing counter wheels as previously described, will essentially provide a means for expanding the readout of the counter by rotation of the indicia rim of the shutter when the highest order counter wheel is indexed from "nine" to "zero" and means will also be provided for resetting the shutter to the zero position during the procedure for resetting the counters of the register.

The operation of the invention to obtain an expanded readout is related to the direction of rotation of the shutter pinion 110 and the adjacent reset gear 30. With reference to FIG. 2, the shutter pinion 110 is illustrated for rotation in the clockwise direction when the shutter pinion 110 is actuated by the highest-order counter wheel. The actuation in preferred form may involve a two-tooth transfer gear segment of the highest-order counter wheel interacting with the mutilated eight-tooth input portion 112 to rotate the output portion 114 90 degrees when the highest order wheel indexes from "nine" to "zero" or 36 degrees. With further reference to FIG. 2, reset gear 30 upon actuation by the reset gear assembly (not shown) of the register to reset the counter to a zero position, rotates in a clockwise direction.

With reference to the upper portion of FIG. 2, the pawl tip 134 bears against a pin 116 of the transfer pinion 110 when the shutter 120 is in the normal or blank position. When the shutter pinion 110 is actuated by the highest-order counter wheel, the shutter pinion 110 rotates in the clockwise direction and the pawl is forced downwardly until tip 134 clears pin 116. As viewed in FIG. 2, during the transfer, pawl 132 essentially is urged downwardly and is further urged to pivot in a counter-clockwise direction resulting in shutter 120 rotating in a counter-clockwise direction on the order of 36 degrees so that the overflow indicia or the numeral "1" is rotated into the count position or in alignment with the readout window as shown in FIG. 1. In the counter 20 the numeral "1", essentially being toward the top of the indicia rim 128, is rotated downwardly to record the expanded readout.

Pawl 132 under the bias of the spring 133 is urged to pivot so that the enlarged tooth 138 engages the teeth of the reset gear 30 as more fully shown in the bottom portion of FIG. 3 for the expanded readout of counter 80. When the reset gear 30 is activated, i.e. to rotate clockwise as shown in FIG. 2, the pawl 130 is engageably rotated in a clockwise upwardly manner as illustrated in FIG. 2 so that the shutter 120 is rotated clockwise and consequently the indicia rim 128 is rotated relative to the readout window resulting in the shutter 120 being rotated back to a blank position. As the pawl 132 is rotated clockwise in an upward manner, the pawl tip overrides the stop end and forces the pawl 132 to disengage the reset gear 30 and the serrated surface 136 to engageably ride on stop end 146 to thereby bring the pawl 132 into a position similar to that of FIG. 2. Shutter 120 and counter 20 are thus now ready for a succeeding fuel pump delivery.

While it is conceivable that the foregoing expanded readout system described for counter 20 may be adaptable for use with all of the counters of the register, such is not generally the case for a conventional register of the type previously described herein because, inter alia, the differences in the relative positions of the counter and transfer pinion shafts, the differences in the rotation of the reset gears relative to the counter wheel rotations, and the space constraints within the register.

The expanded readout system for volume counter 60 comprises a shutter pinion 310, a shutter 320, a pawl means 330, and a stop means 340.

With reference to the lower portion of FIG. 2, in a conventional register the transfer pinion shaft 68 for the volume counter 60 is below the corresponding volume counter shaft 62, i.e. opposite relative orientation to that for pinion shaft 28 and counter shaft 22 of cost counter 20. Shutter pinion 310 is substantially identical to the shutter pinion 110 for the cost counter 20 and is suitably mounted at the higher-order end of the transfer pinion shaft 68 in a manner analogous to that described for the cost counter 20. The shutter 320 for the volume counter comprises a substantially disc-like hub 332 having a slot 326 opening through the periphery thereof and an indicia bearing rim 328 of a construction similar to but not identical to the corresponding shutter 120 for the cost counter. In particular, the shape and relation of the slot 326 relative to the indicia rim 328 is different for the volume shutter 320.

Pawl means 330 comprises a substantially V-shaped pawl 332 which is pivotally mounted proximate its vertex to the shutter hub 322 in eccentric relation thereto. The V-shaped pawl 332 has at one end a serrated surface 336 terminating with an enlarged tooth 338 adapted to engage the adjacent reset gear 70 of the highest-order volume counter wheel. At the opposite end of the V-shaped pawl is a shoulder 334 which is adapted to bear against a pin of the shutter pinion 310 as further illustrated in FIG. 2. A spring 333 connects between the shutter hub 322 and a spring bracket 331 extending proximate the pivot point to urge the V-shaped pawl 332 in clockwise direction so that the tooth 338 is urged into engagement with the reset gear 70.

As viewed in FIG. 2, the shutter pinion 310 and the reset gear 70 when activated rotate in the same clockwise direction as those of the cost counter. In a conventional register the same reset drive gear 18 may drive both the reset gear 30 for the cost counter and the reset gear 70 for the volume counter as illustrated in FIG. 2.

With further reference to the lower portion of FIG. 2, in a blank position, i.e., when the expanded readout is in a blank or zero count position as shown in FIG. 2, the shoulder 334 rests on pin 316 of the shutter pinion 310. Upon actuation of the shutter pinion 310 by the indexing of the highest-order volume counter wheel from the "nine" to "zero" position, the pin 316 rotates clear of the pawl shoulder 334 and the shutter 320 rotates downwardly so that the "1" or the second portion 329 of the indicia rim 328 is brought into the readout window of the register.

A stop 342 is positioned relative to the slot 326 of the shutter 320 and attached to the side frame 14 in a manner analogous to that of the cost counter of the upper portion of FIG. 2.

The spring 333 urges the V-shaped pawl 332 to pivot so that the tooth 336 at the end of the pawl is urged into engagement with the reset gear 70. When the reset gear 70 is activated, it rotates in a clockwise direction and engages tooth 338 of pawl 332 so that the pawl 332 and shutter 320 are rotated clockwise and upwardly similar to that of the pawl 132 of counter 20 of FIG. 2. The serrated surface 336 contacts the triangular shaped end of stop 342 and eventually rides over the top of the stop end. The stop 342 thus functions to disengage the pawl 332 from the teeth of reset gear 70 when the shutter 320 has been rotated to the reset or blank position and the indicia surface 328 is positioned so that the blank portion 327 is in the window. The volume shutter 320 is thus in a reset position or blank position so that it may be activated by the shutter pinion 310 if the expanded readout is required.

It will be appreciated that the different orientations of the transfer pinion shafts relative to the counter shafts and the dimensional constraints of the register as well as the direction of rotations of the transfer pinion shafts and the counter shafts may essentially dictate that a different shutter/pawl mechanism be employed for the front and rear cost counters and for the front and rear volume counters. The expanded readout system employed in conjunction with the rear money counter 40 and the rear volume counter 80 is illustrated in FIG. 3. Because the readouts are essentially accomplished from the opposite side of the register, the rotation of the corresponding shutter pinions 210 and 410 is essentially opposite to that illustrated in FIG. 2. The shutter pinions 210 and 410 of both the rear money and volume counters as viewed in FIG. 3 rotate in the counter-clockwise direction as do the reset gears 50 and 90 of the rear money and volume counters. It is noted that in a conventional register the reset gears 70 essentially rotate in the same clockwise direction for resetting all of the counters. However, the views of FIGS. 2 and 3 are looking in opposite directions which accounts for the clockwise rotation of the reset gear 70 in one view and the counter-clockwise rotation in the other view. The expanded readout system relative to counters 40 and 80 primarily differs from that previously described relative to counters 20 and 60 in terms of reverse pawl, shutter slot, and indicia rim orientations.

With reference to the upper portion of FIG. 3, the shutter pinion 210 is substantially identical to the previously described shutter pinion and is mounted in substantially the same manner. Shutter 220 is also somewhat similar to the previously described shutters but there are significant differences in the orientation of slot 226 which is downwardly relative to shaft 42 and also the relation to the slot 226 to the indicia surface 228.

The shutters employed in the present invention may be constructed of sheet metal aluminum. It is noted that all of the shutters employed in the present invention have a diameter substantially commensurate with that of the counter wheels 25–27. However, the width of the indicia rim is preferably narrower that the width of the indicia rims of the counter wheels in order to accommodate the dimensional constraints of the conventional register.

With further reference to the top portion of FIG. 3, a substantially V-shaped pawl 232 substantially identical to pawl 332 is mounted at its vertex to the shutter hub 222. The V-shaped pawl 232 is urged by spring 233 connected from the shutter hub 222 to a spring bracket 231 proximate the vertex to pivot in a counter-clockwise direction so that the tooth 238 (which in this counter is proximate the bottom of the shutter) is urged to engage the reset gear 50. The other end of the V-shaped pawl 232 comprises a shoulder 234 which is adapted to interact with a pin of the shutter pinion 210 so that when the shutter pinion 210 is actuated by the indexing of the highest order counter wheel from "nine" to "zero", the shoulder 234 clears the pinion pin 216 and the shutter 220 is forced to rotate clockwise in an upward direction so that the numeral "1" or the overflow indicia on the second portion 229 of indicia rim 228 is brought into the window of the cost counter. A stop 242 is fastened to the side frame and positioned below the counter shaft to align with the slot 226 of the shutter 220. As shown in FIG. 3, the stop 242 functions so that the pawl 232 rides over the stop end 246 to disengage from the reset gear 50 after the indicia rim 228 has been rotated during the resetting of the register so that the blank portion 227 is again in the window.

With reference to the lower portion of FIG. 3, the rear volume counter 80 employs a shutter pinion 410 substantially identical to the previously described shutter pinions and mounted to the transfer shaft 88 in substantially the same manner. The corresponding shutter 420 is similar in shape to the previously described shutters but there are again differences in the orientation of the slot 426 in the shutter hub 422 and the relation of the slot 426 with the indicia rim 428. As further shown in the bottom portion of FIG. 3, a pawl 432 substantially identical to pawl 132 is pivotally mounted at one end to the shutter 420 in eccentric relation to the shutter. Pawl 432 is oriented in opposite vertical orientation compared to the previously described pawl 132. Pawl means 430 further comprises a spring bracket 431 and a spring 433 analogous to structures previously described for pawl means 130. A stop means 440 comprising a stop 442 having a threaded end and a free end of a substantially triangular cross-section is identical to stop means 140 and functions in an analogous manner.

Shutter 420 rotates upwardly in a clockwise direction so that the numeral "1" of the indicia rim 428 rotates upwardly to align with the volume counter window upon actuation by shutter pinion 410 through pawl means 430. The shutter is returned to the zero or reset position by the reset gear 70 in manner analogous to those previously described.

The dial face for the conventional four wheel counter register may be replaced by a dial face having a mask which comprises an additional window to align with the shutter for each of the four counters of the register as partially illustrated by window 99 in FIG. 1.

The expanded readout system previously described may be used to expand the readout of all of the counters of a register or portions of the system may be employed to merely expand either a single counter or preferably the front and rear cost counters or the front and rear volume counters as the particular requirements may be. The shutter pinions employed in the present invention may be identical regardless of the particular counter that is to be expanded. However, it is noted that there is essentially provided a different shutter/pawl assembly for each of the four counters depending on the counter to be expanded and the relation of the counter relative to the rotation of the reset gear and the transfer pinion. The invention in a preferred form employs two distinct pawl configurations in order to meet the dimensional constraints and the mechanical design constraints present in the conventional fuel pump register.

The invention also employs essentially two different stop mechanisms differing in the dimension and triangular shape dependent upon the particular pawl mechanism employed by the shutter for the particular counter. The specific location or positioning of the stop means relative to the side frame and relative to the slot of the corresponding shutter is dependent on the specific counter.

The present invention provides a method of expanding the readout of a conventional fuel pump register by mounting a shutter pinion at the higher order end of the transfer pinion shaft by mounting a shutter/pawl assembly at the higher order end of the counter shaft adjacent the reset gear of the highest order counter wheel, by positioning and securing a stop to the side frame and, if necessary, by suitably aligning the shutter with the stop and the pawl means mounted on the shutter with the shutter pinion.

The foregoing steps may be undertaken for each of the counters of the register, it being noted that the appropriate shutter/pawl assembly and the appropriate stop means be selected, and in addition, that the stop means be positioned in the appropriate position to the side frame. In preferred form, the final step of the method of expanding the readout capacity of the register is to replace the dial face with a dial face providing a mask having one or more additional windows to facilitate the readout for the additional shutter or shutters.

One of the advantages of the foregoing system and method is that the expanded readout system is essentially employed in connection with the counting reset mechanism employed in the register, and the expanded readout system thus essentially operates in an efficient manner in conjunction with the mechanical system already in place.

The expanded readout system employs substantially compact components which are complementary with the existing components of the fuel pump register. The present invention has been described for use in connection with counters employing four decade wheels. However, it should be recognized that the present invention is applicable to three counter wheel assemblies and also in counter wheel assemblies employing more than four decade wheels. In addition, the present invention has applicability in connection with fuel pump registers employing expanded readouts whereby the highest order wheel contains indicia greater than 10 numerals such as the fuel pump register with expanded readout system disclosed in U.S. Pat. No. 3,618,852 which employs a highest order counter wheel having 14 numerical indicia. The capacity of the system disclosed in U.S. Pat. No. 3,618,852 which has a cost capacity maximum of $14.99 could be expanded to $19.99 by replacing the highest order wheel by a conventional decade counter wheel and then incorporating the present invention as described in the foregoing description.

As will be apparent to persons skilled in the art, various modifications, adaptions and variations of the foregoing specific disclosure can be made without departing from the spirit and scope of the present invention.

I claim:

1. An expanded readout system for expanding the readout of resettable fuel pump register for registering the cost and volume of each fuel delivery, said register having upper and lower cost and volume counters of a type including a counter shaft, coaxial resettable counter wheels of ascending order mounted thereon, said counter wheels having outer rims bearing sequential indicia, engageable coaxial reset gears for resetting the counter wheels to a zero position, and engageable coaxial drive gears for conditioning the counter for counting, a transfer pinion shaft parallel to the counter shaft, and transfer pinions mounted on the pinion shaft for generating transfers from adjacent lower order to higher order counter wheels, said expanded readout system comprising:

(a) a shutter rotatably mounted on the counter shaft adjacent the reset gear of the highest order counter wheel and having an indicia surface and rotatable between two positions;

(b) a shutter pinion means mounted on the transfer pinion shaft and actuable by the highest order counter wheel; and (c) a pawl means engageable with said shutter pinion means to rotate said shutter indicia surface from a first position to a second position and engageable with said adjacent reset gear to rotate said shutter indicia surface to said first position.

2. The expanded readout system of claim 1 wherein said shutter pinion means comprises a mutilated eight-tooth input section and an output section having four angularly spaced pins.

3. The expanded readout system of claim 1 wherein said shutter comprises a substantially disc-like portion partially defined by a slot.

4. The expanded readout system of claim 3 wherein said indicia surface is a rim partially extending the periphery of said disc-like portion and orthogonal thereto.

5. The expanded readout system of claim 4 wherein said indicia surface further includes a blank portion contiguous to a portion having a numeral "1".

6. The expanded readout system of claim 3 where a stop is positioned in said slot.

7. The expanded readout system of claim 6 wherein the slot is partially defined by a side which interacts with the stop to define the limit of rotation of the shutter.

8. The expanded readout system of claim 6 wherein the pawl means comprises a bow-like pawl pivotally mounted at one end to the shutter.

9. The expanded readout system of claim 8 wherein the pawl end opposite the pivot is adapted to engage said pinion means to that actuation of said pinion means results in rotation of said shutter.

10. The expanded readout system of claim 9 wherein the pawl further comprises at least one tooth adapted to engage the adjacent reset gear.

11. The expanded readout system of claim 10 wherein said stop acts to disengage said pawl tooth from said reset gear upon rotation of said shutter from said second to said first position.

12. The expanded readout system of claim 10 wherein a spring urges the pawl to pivot so that a pawl tooth engages the adjacent reset gear.

13. The expanded readout system of claim 6 wherein the pawl means comprises a substantially V-shaped pawl pivotal at its vertex.

14. The expanded readout mechanism of claim 13 wherein said pawl is pivotally mounted on the shutter.

15. The expanded readout mechanism of claim 14 wherein said pawl is adapted at one end to engage the adjacent reset gear and further comprises at the other end a bearing shoulder adapted to engage the shutter pinion means.

16. The expanded readout mechanism of claim 15 wherein said one pawl end rides over said stop to disengage said reset gear upon said shutter being rotated to said first position.

17. An expanded readout system for a resettable fuel pump register for registering the cost and volume of each fuel delivery, said register having upper and lower cost and volume counters each counter of a type including a counter shaft, coaxial resettable counter wheels of ascending order mounted thereon, said counter wheels having outer rims bearing sequential indicia, engageable coaxial reset gears for resetting the counter wheels to a zero position, and engageable coaxial drive gears for conditioning the counter for counting, a transfer pinion shaft parallel to the counter shaft, and transfer pinions mounted on the pinion shaft for generating transfers from adjacent lower order to higher order counter wheels, said expanded readout system comprising:

(a) a shutter mounted on each of the counter shafts adjacent the reset gears of the highest order counter wheels and having an indicia surface rotatable between a first and a second position;

(b) a shutter pinion means mounted on each of the transfer pinion shafts and actuable by the corresponding highest order counter wheels;

(c) a first pawl means engageable with one of said shutter pinion means to rotate said corresponding shutter indicia surface from a first position to a second position and engageable with said corresponding adjacent reset gear to rotate said one shutter indicia surface to said first position; and (d) a second pawl means engageable with the second of said shutter pinion means to rotate said other corresponding shutter indicia surface from a first position to a second position and engageable with said corresponding adjacent reset gear to rotate said other shutter indicia surface to a first position.

18. The expanded readout system of claim 17 wherein said first pawl means comprises a substantially bow-shaped pawl pivotally mounted at one end to the corresponding shutter.

19. The expanded readout system of claim 18 wherein said second pawl means comprises a substantially V-shaped pawl pivotally mounted at the vertex to the corresponding shutter.

20. The expanded readout system of claim 19 wherein each of said pawls is urged by a spring to pivot in the same clockwise direction.

21. The expanded readout system of claim 19 wherein each of said shutter pinion means has an input section which interacts with the highest order counter wheel and an output section having four angularly spaced pins.

22. The expanded readout system of claim 21 wherein each of said pawls is adapted at one end to engage a pin of the corresponding shutter pinion means.

23. The expanded readout system of claim 22 wherein each of said pawls is eccentric to its corresponding shutter and actuation of the corresponding shutter pinion transmits a force through the pawl to rotate the shutter indicia surface from a first to a second position.

24. The expanded readout system of claim 19 wherein the register further includes a dial face comprising a plurality of windows in alignment with the readout of the counter wheels and the shutters.

25. The expanded readout system of claim 24 wherein the indicia surface includes a blank portion and a numeral "1".

26. The expanded readout system of claim 25 wherein when the shutter indicia surface is in the first position the blank portion aligns with the corresponding shutter window and when the shutter indicia surface is in the second position the numeral "1" aligns with the shutter window.

27. The expanded readout system of claim 19 wherein each of the pawls is adapted to engage the corresponding adjacent reset gear.

28. The expanded readout system of claim 27 further comprising stop means to disengage the pawls from the corresponding adjacent reset gears.

29. The expanded readout system of claim 28 wherein said shutters have a substantially disc-like portion partially defined by a slot, said stop means comprising a stop positioned within said slot.

30. The expanded readout system of claim 29 wherein said register further includes a side panel at the higher order end of the register, said stop being fastened to said side panel and substantially parallel to the counter shaft.

31. An expanded readout system for expanding the readout of a resettable fuel pump register for registering the cost and volume of each fuel delivery, said register having oppositely facing front and rear upper cost counters and front and rear lower volume counters, each counter of a type including a counter shaft, coaxial resettable counter wheels of ascending order mounted thereon, said counter wheels having outer rims bearing sequential indicia, engageable coaxial reset gears for resetting the wheels to a zero position, and engageable coaxial drive gears for conditioning the counter for counting, a transfer pinion shaft parallel to the counter shaft, and a transfer pinion mounted on the pinion shaft for generating transfers from adjacent lower order to higher order counter wheels said expanded readout system comprising:

(a) a shutter rotatably mounted on each of the countershafts adjacent the reset gears of the highest order counter wheels;

(b) a shutter pinion means mounted on each of the transfer pinion shafts and actuable by the corresponding highest order counter wheel; and (c) a pawl means eccentric to each of said corresponding shutters and engageable with said corresponding shutter pinion means and with said corresponding adjacent reset gear to rotate said shutter between a first position and a second position.

32. The expanded readout system of claim 31 wherein said shutter comprises a rim having an indicia surface comprising a blank portion and an indicator portion.

33. The expanded readout system of claim 32 wherein at least on of the pawl means comprises a substantially bow-like pawl pivotally mounted on the corresponding shutter at one end, said bow-like pawl being adapted to engage the corresponding shutter pinion at the other end and having at least one tooth proximate the other end adapted to engage the corresponding adjacent reset gear.

34. The expanded readout system of claim 33 wherein at least one of the pawl means comprises a substantially V-shaped pawl pivotally mounted to the corresponding shutter at the vertex said V-shaped pawl being adapted to engage the shutter pinion at one end and having at least one tooth proximate at the other end adapted to engage the corresponding adjacent reset gear.

35. The expanded readout system of claim 34 wherein one of the corresponding front and rear counters has a bow-like pawl and the other has a V-shaped pawl.

36. The expanded readout system of claim 35 wherein one of the adjacent upper and lower counters has a bow-like pawl and the other has a V-shaped pawl.

37. The expanded readout system of claim 36 wherein the shutter indicia surfaces of the oppositely facing counters rotate in opposite vertical directions to rotate each of the shutters from a first position to a second position.

38. The expanded readout system of claim 37 wherein the register further includes a pair of side panels, and a pair of stop means extending from each of said panels to disengage the pawls from the corresponding adjacent reset gears after the shutters are rotated from the second position to the first position.

39. A method for expanding the readout of a resettable fuel pump register for registering the cost and volume of each fuel delivery, said register having upper and lower cost and volume counters and front and rear dial faces providing windows to read the cost and volume, said counters intermediate a pair of spaced side frames and of a type including a counter shaft, coaxial resettable counter wheels of ascending order mounted thereon, said counter wheels having outer rims bearing sequential indicia, engageable coaxial reset gears for resetting the counter wheels to a zero position, and engageable coaxial drive gears for conditioning the counter for counting, a transfer pinion shaft parallel to the counter shaft, and transfer pinions mounted on the pinion shaft for generating transfers from adjacent lower order to higher order counter wheels, said method comprising:

(a) providing a shutter pinion means;

(b) providing a shutter having an indicia rim, a slot, and a pawl means engageable with said shutter pinion means and with a reset gear;

(c) providing a stop means to disengage said pawl means from the reset gear;

(d) mounting the shutter pinion means on the transfer pinion shaft;

(e) mounting the shutter at the highest order end of the counter shaft adjacent the reset gear of the highest order counter wheel;

(f) mounting the stop means to the adjacent side frame;

(g) aligning the stop means with the slot; and (h) aligning the shutter pinion with the pawl means.

40. The method of claim 39 wherein the steps (a)–(h) are repeated for each of the counters.

41. The method of claim 40 wherein each of the shutters provided in step (b) are different.

42. The method of claim 41 wherein at least one of the shutters has a pawl means comprising a substantially bow-shaped pawl and at least one of the shutters has a pawl means comprising a substantially V-shaped pawl.

43. The method of claim 42 further comprising the step of selecting a shutter having a bow-shaped pawl for a front counter and a shutter having a V-shaped pawl for a corresponding rear counter.

44. The method of claim 43 further comprising the step of selecting a shutter having a bow-shaped pawl for upper counter and shutter having a V-shaped pawl for an adjacent lower counter.

45. The method of claim 44 further comprising the step of selecting one type of stop means for use with a shutter having a bow-like pawl and a second type of stop means for a shutter having a V-shaped pawl.

46. The method of claim 39 further including the step of replacing a dial face with a dial face including at least one additional window to provide a shutter reading.

47. The method of claim 40 further including the steps of replacing the front and rear dial faces with dial faces including additional windows to provide shutter readings.

* * * * *